United States Patent [19]

DaRosa

[11] Patent Number: 4,610,392

[45] Date of Patent: Sep. 9, 1986

[54] PORTFOLIO ADAPTED FOR INCORPORATION OF A PAPER PAD

[75] Inventor: Adelino B. DaRosa, Springfield, Mass.

[73] Assignee: Ampad Corporation, Holyoke, Mass.

[21] Appl. No.: 683,345

[22] Filed: Dec. 19, 1984

[51] Int. Cl.[4] ..... B65D 37/00

[52] U.S. Cl. ..... 229/1.5 R; 281/15 B

[58] Field of Search ..... 229/1.5 R, 72; 281/29, 281/31, 15 B

[56] References Cited

U.S. PATENT DOCUMENTS

| | | | |
|---|---|---|---|
| 958,507 | 5/1910 | Kuhn | 281/31 |
| 1,460,426 | 7/1923 | McSheehy | 281/31 |
| 2,108,015 | 2/1938 | Kalish | 281/29 |
| 2,676,818 | 4/1954 | Blumberg | 281/15 B |
| 2,828,975 | 4/1958 | Wright | 281/31 |
| 3,058,506 | 10/1962 | Parisi | 229/72 |
| 3,102,739 | 9/1963 | Larson | 281/15 B |
| 3,105,495 | 10/1963 | Heyer | 281/15 B |
| 3,870,223 | 3/1975 | Wyant | 229/1.5 R |
| 4,420,112 | 12/1983 | Cline | 281/31 |

FOREIGN PATENT DOCUMENTS

| | | | |
|---|---|---|---|
| 537383 | 4/1955 | Belgium | 281/29 |

*Primary Examiner*—Stephen P. Garbe

*Attorney, Agent, or Firm*—Fishman & Dionne

[57] ABSTRACT

An inexpensive portfolio formed from a single, integral, die-cut blank and adapted for securing and incorporating a paper pad is presented. The portfolio may alternatively contain one or more pockets. Preferably, the incorporated paper pad is of the type having its binding along the top end such as a legal pad.

5 Claims, 3 Drawing Figures

PORTFOLIO ADAPTED FOR INCORPORATION OF A PAPER PAD

BACKGROUND OF THE INVENTION

This invention relates to portfolios, and more particularly to an inexpensive portfolio formed from a single, integral, die-cut blank and adapted for securing a paper pad. The secured paper pad is preferably of the type having its binding at the top end thereof. In a preferred embodiment, one or more pockets may be provided with the portfolio.

Examples of simple and inexpensive portfolios assembled from one or more pieces of paper or board may be found in U.S. Pat. Nos. 1,524,647, 2,161,015, 2,828,975, 3,310,321, 3,870,223 (and patents cited therein) and 4,391,457. These patents generally disclose blanks for forming portfolios having one or more interior or exterior pockets of varying sizes and shapes. Some of the prior art patents also disclose means for securing one or more paper pads to the interior of the portfolio. For example, U.S. Pat. No. 2,161,015 describes a plurality of sockets, each socket being adapted to receive the tongue of a memorandum pad. U.S. Pat. Nos. 1,524,647, 2,828,975 and 3,870,223 all disclose large pockets for receiving a portion of a paper pad. Finally, U.S. Pat. No. 4,396,457 sets forth a portfolio having strips of pressure sensitive adhesive for retaining the bound edge of a paper pad.

While the above-discussed prior art patents are suitable for their intended purposes, none of the patents disclose simple and inexpensive means for directly incorporating a paper pad in the portfolio to form an integral and attractive construction.

Accordingly, it is a principle object of the present invention to provide a single, integral die-cut blank which is adapted to secure a paper pad and which overcomes the deficiencies of the prior art.

It is another object of the present invention to provide a single die-cut blank which includes simple and inexpensive means for directly incorporating a paper pad in a portfolio to form an integral and attractive construction.

DESCRIPTION OF THE DRAWINGS

These and other objects will become apparent from the following detailed description taken in connection with the accompanying drawings wherein.

DESCRIPTION OF THE PREFERRED EMBODIMENT

Figure 1:
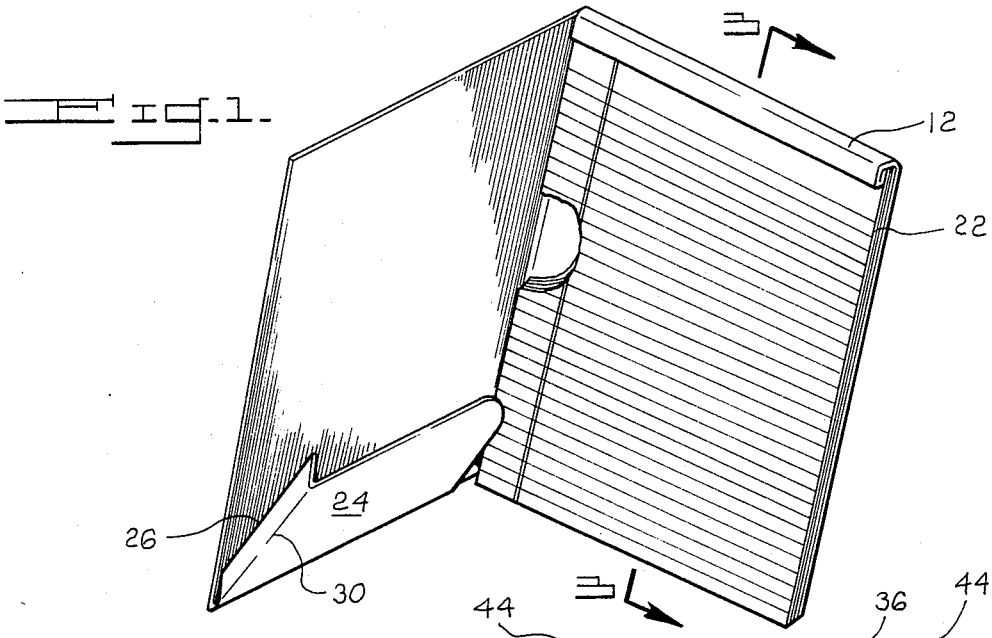
FIG. 1 is a perspective view of the portfolio having a paper pad attached thereto in accordance with the present invention.
Figure 2:
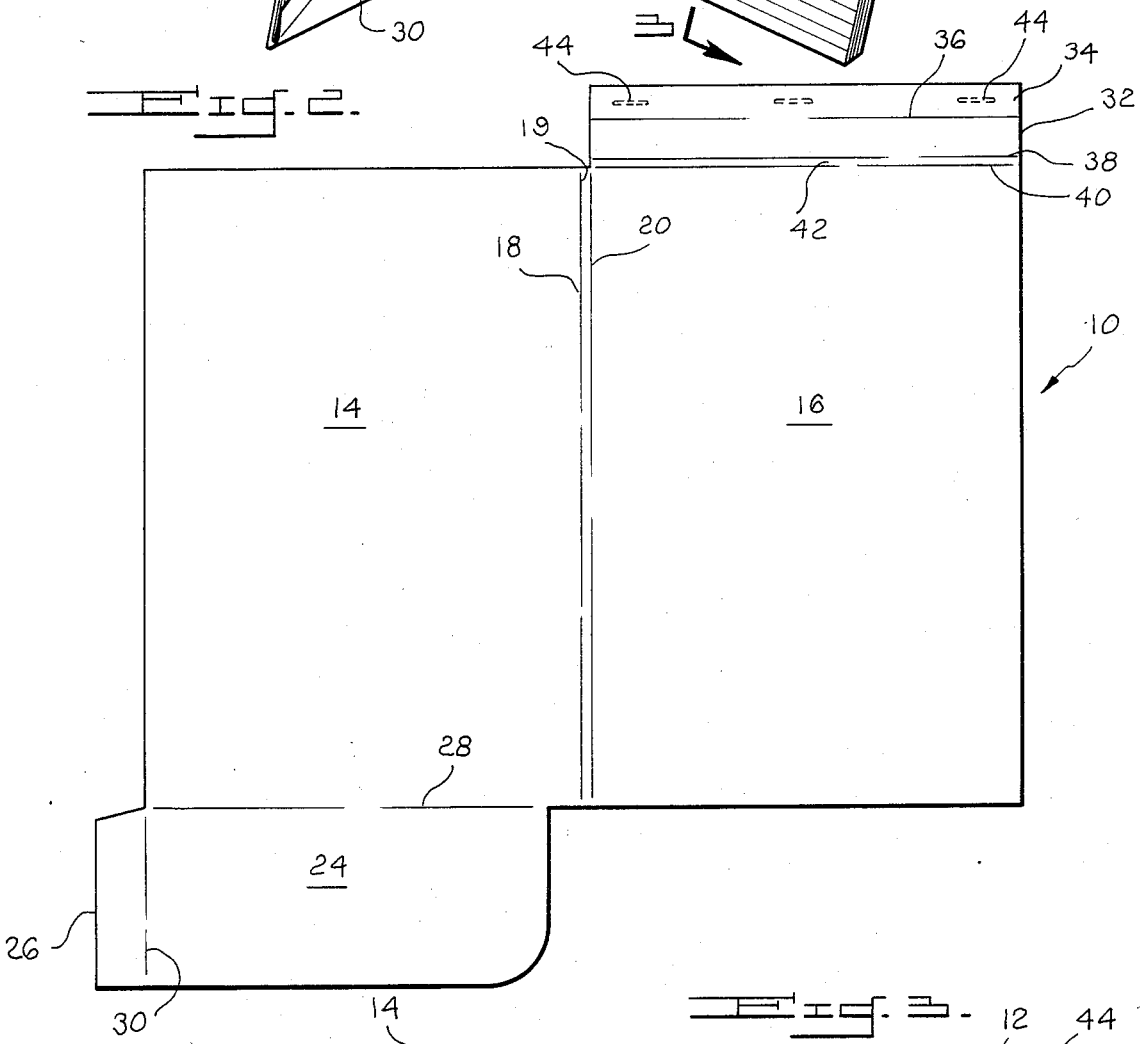
FIG. 2 is a plan view of a die-cut blank of the portfolio in accordance with the present invention.
Figure 3:
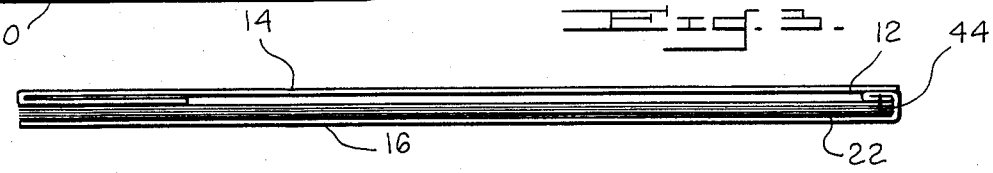
FIG. 3 is a cross-sectional elevation view along the line 3—3 of FIG. 1.

Referring jointly to FIGS. 1–3, FIG. 2 illustrates the single, unitary blank 10 which forms the portfolio 12 shown in FIG. 1. Referring to FIG. 2, blank 10 is a one-piece blank which includes a front outer panel 14 and a rear outer panel 16 preferably separated by a pair of center fold lines 18 and 20. It will be appreciated that only one center fold line may be used, but two are preferred in order to provide spacing 19 for a paper pad 22. In a preferred embodiment, front panel 14 includes a panel 24 extending from its bottom end. Pocket panel

24, having an end flap 26 extending therefrom, forms an optional pocket after being folded at both fold lines 28 and 30 as shown in FIGS. 1 and 3.

An important feature of the portfolio of the present invention is a novel means for securing or attaching a paper pad of the type having a bound end to rear panel 16. This novel attachment means includes an extension flap 32 extending from the upper end of panel 16 and having the same width as panel 16 and an end flap 34, attached to extension 32, flap 34 being oppositely disposed on extension 32 from panel 16. End flap 34 and extension flap 32 are separated along a fold line 36 while flap 32 and panel 16 are preferably separated by a pair of fold lines 38 and 40. Fold lines 38 and 40, in turn, define a intermediate panel 42 therebetween. It will be appreciated that intermediate panel 42 provides spacing which accomodates the particular thickness of paper pad 22.

As mentioned, the portfolio of the present invention is especially adapted to retain or receive a paper pad therein, preferably a paper pad having a binding along the top end thereof. Referring to the FIGURES, the binding of a paper pad 22 (i.e., a well-known legal pad or other memorandum pad having the binding across the top edge) is permanently attached to end flap 34 by adhesive, staples (shown schematically by dotted lines 44), a combination of the foregoing or any other suitable means. It is important that the front face of the binding of pad 22 be attached to the back side of flap 34 to insure proper orientation of pad 22 in portfolio 12. This arrangement permits the pad to be pivotally displaced from the body of the portfolio 12 so as to allow the use of same with the front panel 14 closed. Following this attachment, end flap 34 (with attached pad 22 thereon) is folded at fold line 36 onto extension flap 32. Thereafter, both flaps 32 and 34 (along with attached pad 22) are folded at fold lines 38 and 40 until the back of pad 22 is flush with panel 16 as shown in FIG. 1. Note that the pad 22 in FIG. 1 has a portion thereof cut-away to indicate its orientation with panel 16.

As discussed, portfolio 12 may include one or more option pockets such as the side pocket comprised of pocket panel 24 and end flap 26. As shown in FIGS. 1 and 2, this side pocket is provided by folding pocket panel 24 upwardly toward panel 14 along fold line 28 and folding end flap 26 inwardly towards panel 14 along fold line 30. Thereafter, end flap 26 is adhesively or otherwise attached to panel 14 to form a pocket defined between panels 14 and 28.

The portfolio 12 is closed by folding along fold lines 18 and 20 to form a binding defined by the intermediate panel 19. It will be appreciated that the front (outer face) of panel 14 may include any suitable indicia and, for example, may be printed for any number of applications such as colleges, conventions, hotels and businesses to name but a few.

It will also be appreciated that blank 10 may be made from any suitable material, but not limited to paper, board, plastic coated paper or board, etc.

As is clear from the foregoing description, the portfolio of the present invention includes a novel and simplified means of attaching and incorporating a paper pad therein. This novel attaching means is comprised of a series of flaps and panels separated by fold lines which are all part of a unitary die-cut blank 10. The portfolio is economical due to its low cost construction and provides an attractive paper pad holder for a myriad of uses and applications.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A portfolio comprising:

a front panel, said front panel having a top end and a bottom end;

a rear panel hingedly connected to said front panel along a first center fold line, said rear panel having a top end and a bottom end;

an extension flap attached to the top end of said rear panel along a pair of fold lines;

an intermediate panel defined between said pair of fold lines;

an end flap hingedly connected to said extension flap along a second fold line, said end flap being oppositely disposed on said extension flap from said rear panel;

a paper pad having a bound end, said bound end of said paper pad being affixed only to said end flap thereby permitting said paper pad to be pivotally displaced from said portfolio.

2. The portfolio of claim 1 wherein:

said extension flap and end flap have a length about equal to the length of said top end of said rear panel.

3. The portfolio of claim 1 further including:

a second center fold line adjacent said first center fold line and forming a second intermediate panel therebetween.

4. The portfolio of claim 1 further including:

a pocket panel hingedly connected to the bottom end of said front panel along a fold line; and an end flap hingedly connected to said pocket panel.

5. The portfolio of claim 1 wherein:

said paper pad is of the type having its binding along the top end thereof.

* * * * *